US006300604B1

(12) United States Patent
Wilkins

(10) Patent No.: US 6,300,604 B1
(45) Date of Patent: Oct. 9, 2001

(54) RADIANT ELECTRIC HEATER

(75) Inventor: Peter Ravenscroft Wilkins, Droitwich (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 09/816,301

(22) Filed: Mar. 23, 2001

(30) Foreign Application Priority Data

Mar. 23, 2000 (GB) ..... 0006899

(51) Int. Cl.[7] ..... H05B 3/68
(52) U.S. Cl. ..... 219/448.11; 219/448.19
(58) Field of Search ..... 219/446.1, 448.11, 219/448.12, 448.14, 448.16, 448.19, 458.1, 459.1, 460.1, 461.1

(56) References Cited

U.S. PATENT DOCUMENTS 4,538,051 * 8/1985 Schreder et al. ..... 219/448.19
5,270,519 * 12/1993 Higgins ..... 219/448.19
5,420,398 * 5/1995 Petri et al. ..... 219/448.19
5,796,075 * 8/1998 Gross et al. ..... 219/448.19
5,961,867 * 10/1999 McWilliams ..... 219/448.19
6,051,816 * 4/2000 Wilkins ..... 219/448.19

FOREIGN PATENT DOCUMENTS 0948239 10/1999 (EP) .
1212941 11/1970 (GB) .

OTHER PUBLICATIONS

European Search Report Aug. 25, 2000.

* cited by examiner

*Primary Examiner*—Sang Paik
(74) *Attorney, Agent, or Firm*—Ira S. Dorman

(57) ABSTRACT

A radiant electric heater comprises a base (2) of thermal and electrical insulation material, an electrical heating element (3) supported on or adjacent to the base and having a terminal region (7) at a location in the heater remote from a periphery of the heater, and a rod-like temperature-responsive device (9) extending at least partly across the heater from the periphery thereof at least to a region proximate the terminal region of the heating element. Electrical connecting means extends from the terminal region (7) of the heating element (3) to the periphery of the heater by way of the rod-like temperature-responsive device (9).

14 Claims, 2 Drawing Sheets

RADIANT ELECTRIC HEATER

This invention relates to a radiant electric heater particularly, but not exclusively, for use in cooking appliances, such as glass-ceramic cooking appliances.

BACKGROUND TO THE INVENTION

Radiant electric heaters are well known comprising a base of thermal and electrical insulation material having at least one electrical heating element supported on or adjacent thereto. The base may comprise compacted microporous insulation material and may be provided in a dish-like support, such as of metal.

The heating element or elements is or are generally of elongate coiled wire or ribbon form, having electrical terminations at opposite ends thereof for connection to a power supply.

A rod-like temperature-responsive device is also generally provided extending at least partly across the heater and overlying the heating element or elements.

DESCRIPTION OF PRIOR ART

In one known arrangement, the heating element is provided in a pattern incorporating one or more reversals and such that both ends of the element are situated at the periphery of the heater and preferably close to each other, where they can be readily provided with electrically conductive terminations, such as in a terminal block, to enable the element to be connected to a power supply.

However another arrangement is known in which the heating element is arranged in a pattern such that one end is at the periphery of the heater and the other end is at a location in the heater remote from the periphery, for example at or near the middle of the heater. With such an arrangement, which may occur when the heating element is provided in the form of a simple spiral, it is necessary to provide a wire link connected to that end termination of the heating element located remote from the periphery of the heater and extending to the periphery of the heater. One such wire link is known, provided externally of the heater and passing through an aperture at the centre of the base of the heater. However a wire link of this nature, passing through the base, increases the overall depth of the heater, which is undesirable.

Alternatively, a wire link is known which is provided in or beneath the insulation material of the base. However, the provision of such a link necessitates additional processing steps in the manufacture of the heater, thereby adding to the cost of the heater.

OBJECT OF THE INVENTION

It is an object of the present invention to overcome or minimise these disadvantages.

SUMMARY OF THE INVENTION

The present invention provides a radiant electric heater comprising a base of thermal and electrical insulation material, an electrical heating element supported relative (on or adjacent) to the base and having a terminal region at a location in the heater remote from a periphery of the heater, a rod-like temperature-responsive device extending at least partly across the heater from the periphery thereof at least to a region proximate the terminal region of the heating element, and electrical connecting means extending from the terminal region of the heating element to the periphery of the heater by way of the rod-like temperature-responsive device.

The rod-like temperature-responsive device may comprise a differentially-expanding rod and tube assembly having a rod arranged inside a tube and adapted to operate switch means at a periphery of the heater.

The rod and/or the tube may comprise a metal and serve as the electrical connecting means.

The tube may also include an electrical lead passing therethrough and serving as the electrical connecting means.

The tube may be provided with at least two bore-holes passing therethrough, one containing the rod and the other containing the electrical lead serving as the electrical connecting means.

The tube may comprise an electrical insulating material, such as a material selected from ceramic, glass, glass-ceramic, quartz and fused vitreous silica, and the rod may comprise a metal.

Alternatively the rod-like temperature-responsive device may comprise a tube in which is provided an electrical element having an electrical parameter which changes as a function of temperature. Such electrical element may comprise an electrical resistance device whose electrical resistance changes as a function of temperature.

The tube in which the electrical element is provided may comprise a metal and serve as the electrical connecting means.

Alternatively the tube in which the electrical element is provided may include an electrical lead passing therethrough which is electrically connected to the terminal region of the at least one heating element and serves as the electrical connecting means. In this case the tube may comprise an electrically insulating or conducting material, such as a material selected from metal, ceramic, glass-ceramic, quartz and fused vitreous silica.

The electrical heating element may be of wire, ribbon, film or foil form and may be arranged substantially in the form of a spiral.

By means of the invention, an electrical connection can be readily provided from a region of a heating element remote from the periphery of a heater to a peripheral region of the heater by way of the rod-like temperature-responsive device, thus eliminating the need for a lead buried in or beneath an insulation base of the heater, or for a lead passing through an aperture in the base of the heater.

For a better understanding of the invention and to show more clearly how it may be carried into effect, reference will now be made, by way of example, to the accompanying drawings in which:

DESCRIPTION OF PREFERRED EMBODIMENTS

Figure 1:
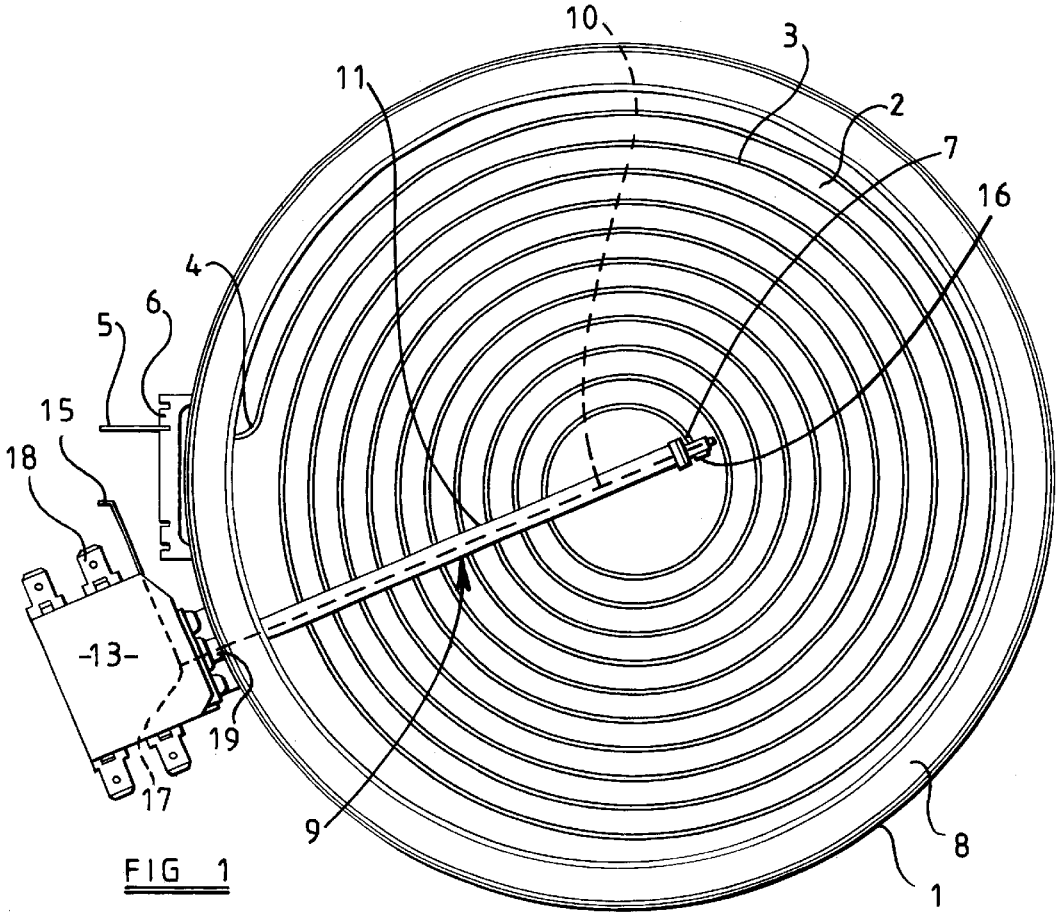
FIG. 1 is a plan view of one embodiment of a radiant electric heater according to the present invention.
Figure 2:
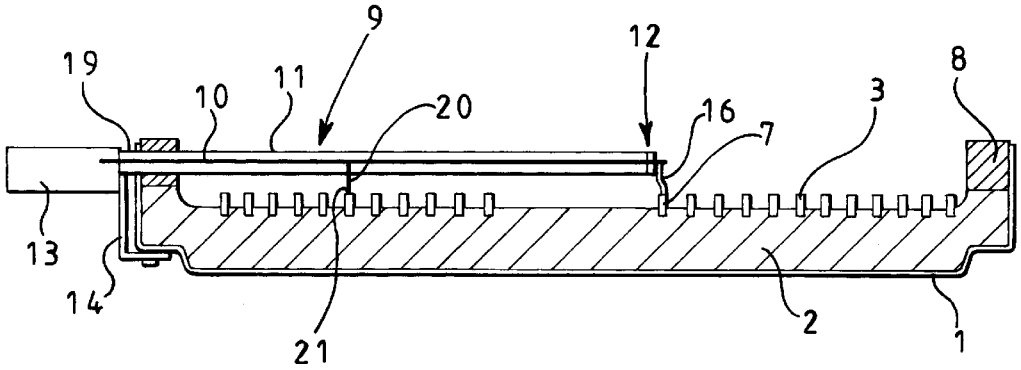
FIG. 2 is a cross-sectional view of the radiant electric heater of FIG. 1.

Referring to FIGS. 1 and 2, a radiant electric heater, such as for use in a cooking appliance, comprises a metal dish 1 containing a base layer 2 of thermal and electrical insulation material, particularly compacted microporous thermal and electrical insulation material which is well known to the skilled person.

An electrical heating element 3 is supported on the base layer 2. The heating element 3 may be of any of the well known forms, such as wire, ribbon, film or foil. A particularly well known form of element 3, as shown in FIGS. 1 and 2, comprises a corrugated metal ribbon mounted edgewise on the surface of the base layer 2.

The heating element 3 is arranged in the form of a spiral, having one end 4 connected to a terminal 5 in a terminal block 6 provided at a peripheral region of the heater.

The heating element 3 also has an end region 7 at a central region of the heater remote from the periphery of the heater.

A well known form of wall 8, of thermal insulation material, is provided around the periphery of the heater against the side of the dish 1.

A rod-like temperature-responsive device 9 extends partly across the heater from the periphery thereof and is of generally well known basic construction. The device 9 comprises a differentially-expanding rod and tube assembly comprising a rod 10 inside a tube 11. The rod 10 and tube 11 are secured together at one end 12 and operate switch means of well known form in a switch head 13 arranged outside the heater at the periphery thereof.

The temperature-responsive device 9 is secured to the dish 1 of the heater by a bracket 14.

The device 9 may comprise a relatively high thermal expansion metal rod 10 inside a relatively low thermal expansion tube 11, or may comprise a relatively high thermal expansion metal tube 11 containing a relatively low thermal expansion rod 10. Both forms of construction are well known to the skilled person. The relatively low thermal expansion rod or tube may, for example, comprise a material selected from ceramic, glass, glass-ceramic, quartz and fused vitreous silica. The relatively high thermal expansion metal rod or tube may comprise a material such as a high temperature withstanding steel or an iron-chromium-aluminium alloy.

In accordance with the present invention, the metal component of the rod and tube assembly, whether the rod 10 or the tube 11, is used as an electrical connecting means between the end region 7 of the heating element 3 and a terminal region 15 at the periphery of the heater and such that the heating element 3 is able to be connected by the terminal regions 5, 15 to a power supply for operation.

As shown, the end region 7 of the heating element 3 is electrically connected by a connecting link 16 to the end of metal rod 10 which extends from insulating tube 11 at the end region 12 of the rod and tube assembly. The connecting link 16 can be part of the end region 7 of the heating element 3, or can be a separate conducting wire or tape welded to the end region 7 of the heating element. The connecting link 16 is suitably secured and electrically connected to the end of the metal rod 10 by welding.

Terminal region 15, provided at the periphery of the heater, comprises a lead wire electrically connected to an end region 17 of the metal rod 10, suitably inside the switch head 13.

It is arranged for the metal rod 10 to be electrically isolated from the switch means inside the switch head 13, for example by means of an intermediate ceramic member.

If desired, the terminal region 15 could be connected to, or integral with, a terminal 18 on the switch head 13. Such connection could be made either externally or internally on the switch head 13, the latter obviating the need for the terminal region 15 to extend outside the switch head 13.

If the outer tube 11 of the temperature-responsive device 9 comprises a metal and the inner rod is of insulating material, the end region 7 of the heating element 3 is then arranged to be electrically connected to the tube 11, at the end region 12 of the rod and tube assembly, instead of to the rod 10. At the other end of the rod and tube assembly, the lead wire of terminal region 15 is arranged to be connected to the end 19 of the tube 11 instead of to the end 17 of the rod 10.

Instead of the end region 7 of the heating element 3 being electrically connected to the metal tube 11 of the temperature-responsive device, it could be arranged for a connection 20 to be made between a tapping point 21 on the heating element 3 and the metal tube 11, to enable controlled energising of one or more selected regions of the heating element 3 to be effected.

Figure 3:
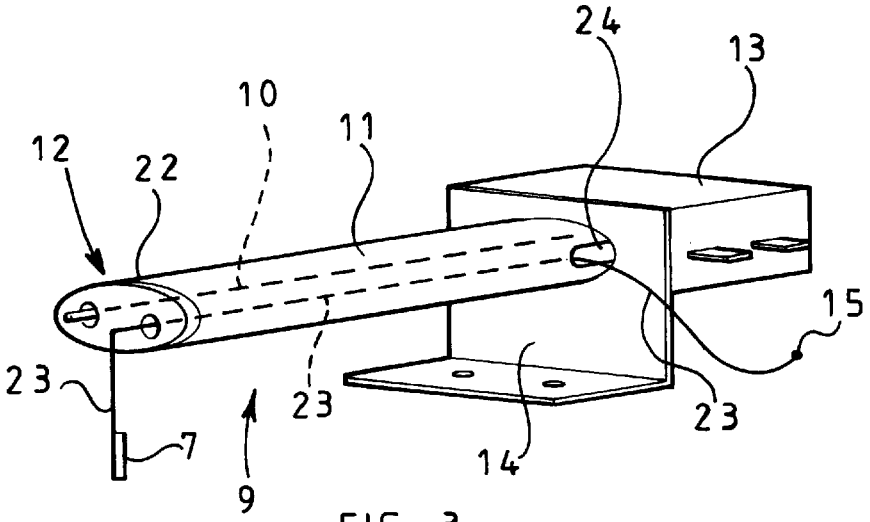
FIG. 3 is a perspective view of an alternative embodiment of temperature-responsive device for use in the radiant electric heater of FIG. 1.

An alternative arrangement of the temperature-responsive device 9 is illustrated in FIG. 3. Here the tube 11, of electrically insulating material, is provided with two bore-holes running through it along its length, one of which carries metal rod 10 which is secured to the tube 11 at end 12 by means of a metal collar arrangement 22. The other end of the metal rod 10 operates one or more switch means inside switch head 13. The other bore-hole through the tube 11 carries an electrically conducting lead wire 23 which at one end is electrically connected to the end region 7 of the heating element 3 and at the other end extends through an aperture 24 in the tube 11 to form terminal region 15 for the heating element.

The device 9 is secured to the heater by means of bracket 14 in the same way as the arrangement shown in FIGS. 1 and 2.

The tube 11 is shown of elliptical cross section. Although this may be advantageous in order to maintain a low profile for the device, it is not essential and other cross-sectional shapes, such as circular or rectangular, could be considered.

The rod 10 and tube 11 of FIG. 3 are suitably constructed of the same materials as described for the corresponding rod and tube in FIGS. 1 and 2.

Figure 4:
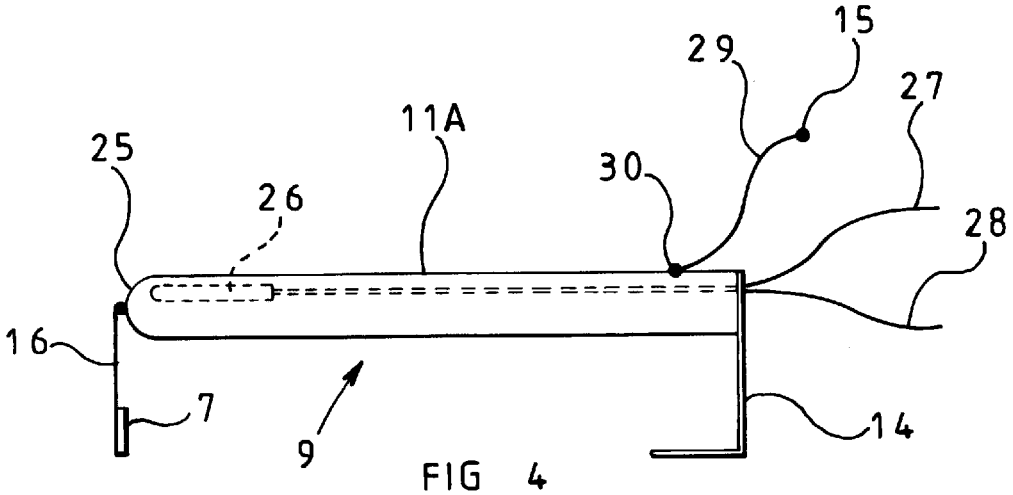
FIG. 4 is a side view of another alternative embodiment of temperature-responsive device for use in the radiant electric heater of FIG. 1.

Another arrangement of the temperature-responsive device 9 is illustrated in FIG. 4. A metal tube 11A, closed at one end 25, contains an electrical element 26 having an electrical parameter which changes as a function of temperature. Element 26 is suitably an electrical resistance element, such as a platinum resistance element, whose electrical resistance changes as a function of temperature.

The device 9 is secured to the heater in much the same way as the corresponding device 9 shown in FIGS. 1 and 2, by means of a bracket 14.

Lead wires 27, 28 are connected to the element 26 and extend outside the heater to appropriate monitoring and control circuitry (not shown) for the heater.

The metal tube 11A is used as an electrical connecting means between the end region 7 of the heating element 3 and a terminal region 15 at the periphery of the heater. As previously described with reference to FIGS. 1 and 2, a connecting link 16 is provided between the end region 7 of the heating element 3 and the end 25 of the metal tube 11A. Link 16 can be part of the end region 7 of the heating element 3, or can be a separate connecting wire or tape, and is secured to the end 25 of the metal tube 11A by welding. Terminal region 15 for the heating element is provided by welding a lead wire 29 to an opposite end region 30 of the metal tube 11A.

Figure 5:
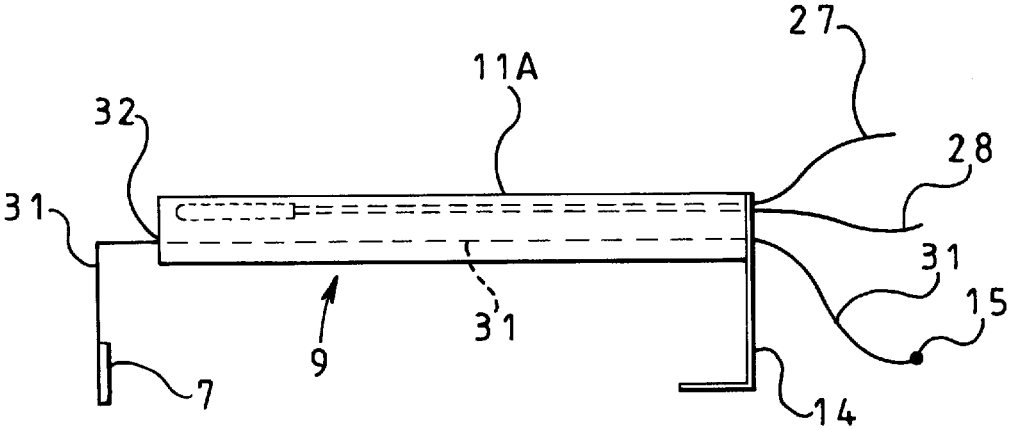
FIG. 5 is a side view of yet another alternative embodiment of temperature-responsive device for use in the radiant electric heater of FIG. 1.

FIG. 5 shows a variation on the arrangement of FIG. 4 in which, instead of using tube 11A as the connecting means, a lead wire 31 is provided, connected to the end region 7 of the heating element 3 and passing along the interior of the tube 11A to terminal region 15, a hole 32 being provided in the end of the tube 11A for entry of the lead wire 31. In this case, the tube 11A can be formed of a metal, or an insulating material such as ceramic, glass, glass-ceramic, quartz or fused vitreous silica.

I claim:

1. A radiant electric heater comprising a base of thermal and electrical insulation material, an electrical heating element supported relative to the base and having a terminal region at a location in the heater remote from a periphery of the heater, a rod-like temperature-responsive device extending at least partly across the heater from the periphery thereof at least to a region proximate the terminal region of the heating element, and electrical connecting means extending from the terminal region of the heating element to the periphery of the heater by way of the rod-like temperature-responsive device.

2. A radiant electric heater as claimed in claim 1, wherein the rod-like temperature-responsive device comprises a differentially-expanding rod and tube assembly having a rod arranged inside a tube and adapted to operate switch means at the periphery of the heater.

3. A radiant electric heater as claimed in claim 2, wherein at least one of the rod and the tube comprises a metal and serves as the electrical connecting means.

4. A radiant electric heater as claimed in claim 2, wherein the tube includes an electrical lead passing therethrough and serving as the electrical connecting means.

5. A radiant electric heater as claimed in claim 4, wherein the tube is provided with at least two bore-holes passing therethrough, one containing the rod and the other containing the electrical lead serving as the electrical connecting means.

6. A radiant electric heater as claimed in claim 3, wherein the tube comprises an electrical insulating material and the rod comprises a metal.

7. A radiant electric heater as claimed in claim 6, wherein the electrical insulating material of the tube is selected from ceramic, glass, glass-ceramic, quartz and fused vitreous silica.

8. A radiant electric heater as claimed in claim 1, wherein the rod-like temperature-responsive device comprises a tube in which is provided an electrical element having an electrical parameter which changes as a function of temperature.

9. A radiant electric heater as claimed in claim 8, wherein the electrical resistance of the electrical element changes as a function of temperature.

10. A radiant electric heater as claimed in claim 8, wherein the tube in which the electrical element is provided comprises a metal and serves as the electrical connecting means.

11. A radiant electric heater as claimed in claim 8, wherein the tube in which the electrical element is provided includes an electrical lead passing therethrough which is electrically connected to the terminal region of the heating element and serves as the electrical connecting means.

12. A radiant electric heater as claimed in claim 11, wherein the material of the tube is selected from electrically insulating and electrically conducting material.

13. A radiant electric heater as claimed in claim 12, wherein the tube comprises a material selected from metal, ceramic, glass, glass-ceramic, quartz and fused vitreous silica.

14. A radiant electric heater as claimed in claim 1, wherein the electrical heating element is arranged substantially in the form of a spiral.

* * * * *